US008468837B2

(12) United States Patent
Pinet

(10) Patent No.: US 8,468,837 B2
(45) Date of Patent: Jun. 25, 2013

(54) HIGH EFFICIENCY THERMOELECTRIC COOLING SYSTEM AND METHOD OF OPERATION

(76) Inventor: Claude Pinet, Sorel-Tracy (CA)

( * ) Notice: Subject to any disclaimer, the term of this patent is extended or adjusted under 35 U.S.C. 154(b) by 668 days.

(21) Appl. No.: 12/644,319

(22) Filed: Dec. 22, 2009

(65) Prior Publication Data

US 2011/0083446 A1 Apr. 14, 2011

(30) Foreign Application Priority Data

Oct. 14, 2009 (CA) ..... 2682442

(51) Int. Cl.

| | |
|---|---|
| ***F25B 21/02*** | (2006.01) |
| ***F25B 21/00*** | (2006.01) |
| ***F25D 17/06*** | (2006.01) |
| ***F17C 13/00*** | (2006.01) |
| ***H02J 1/02*** | (2006.01) |
| ***H02M 1/12*** | (2006.01) |
| ***H02M 1/14*** | (2006.01) |

(52) U.S. Cl.
USPC ..... 62/3.6; 62/3.7; 62/412; 62/427; 62/428; 62/457.9; 363/39; 363/48

(58) Field of Classification Search
USPC 62/3.6, 3.7, 457.9, 428, 412, 427; 363/39–48
See application file for complete search history.

(56) References Cited

U.S. PATENT DOCUMENTS

| | | | | |
|---|---|---|---|---|
| 4,726,193 | A | 2/1988 | Burke et al. | |
| 5,283,726 | A * | 2/1994 | Wilkerson | 363/41 |
| 5,505,046 | A | 4/1996 | Nelson et al. | |
| 5,522,216 | A | 6/1996 | Park et al. | |
| 5,605,047 | A | 2/1997 | Park et al. | |
| 5,713,208 | A * | 2/1998 | Chen et al. | 62/3.7 |
| 5,775,113 | A * | 7/1998 | Schulak | 62/89 |
| 5,884,487 | A * | 3/1999 | Davis et al. | 62/3.64 |
| 6,574,967 | B1 * | 6/2003 | Park et al. | 62/3.3 |
| 7,032,389 | B2 * | 4/2006 | Cauchy | 62/3.3 |
| 7,051,536 | B1 * | 5/2006 | Cohen et al. | 62/3.3 |
| 7,448,222 | B2 * | 11/2008 | Bormann | 62/3.7 |
| 7,451,603 | B2 | 11/2008 | Tuszkiewicz et al. | |
| 7,918,092 | B2 * | 4/2011 | Lin et al. | 62/3.7 |
| 2002/0121094 | A1 * | 9/2002 | VanHoudt | 62/3.3 |
| 2005/0109040 | A1 | 5/2005 | Hansen | |
| 2005/0235652 | A1 * | 10/2005 | Iwasaki | 62/3.7 |
| 2006/0117761 | A1 | 6/2006 | Bormann | |
| 2006/0288729 | A1 * | 12/2006 | Arjomand | 62/441 |
| 2007/0051113 | A1 | 3/2007 | Bang | |
| 2007/0119187 | A1 * | 5/2007 | Kitchens et al. | 62/3.6 |
| 2007/0193280 | A1 | 8/2007 | Tuskiewicz et al. | |
| 2008/0011011 | A1 | 1/2008 | Van Meter et al. | |
| 2008/0163628 | A1 | 7/2008 | Lilke | |
| 2008/0168775 | A1 * | 7/2008 | Windheim et al. | 62/3.7 |
| 2008/0271464 | A1 | 11/2008 | Crippen et al. | |
| 2009/0001861 | A1 | 1/2009 | Welker et al. | |

* cited by examiner

*Primary Examiner* — Frantz Jules
*Assistant Examiner* — Filip Zec
(74) *Attorney, Agent, or Firm* — Norton Rose Canada LLP

(57) ABSTRACT

A high efficiency thermoelectric cooling system and method is described. The cooling system has a thermoelectric module having a semi-conductor body sandwiched in contact between a pair of thermally conductive plates. A smooth continuous variable output direct current source supplies the semi-conductor body to attenuate thermal stress in the conductive plates due to temperature differential fluctuation across the plates. Current flow in the semi-conductor body transfers heat from one plate to the other plate. A cold heat sink absorbs heat from the cold plate. A heat convection assembly, including a hot heat sink, evacuates heat from the hot plate. The thermoelectric cooling device is secured to a wall of an insulated enclosure. An air convection housing may b provided to evacuate heat from the hot heat sink using an outside air supply or ambient air supply.

32 Claims, 7 Drawing Sheets

HIGH EFFICIENCY THERMOELECTRIC COOLING SYSTEM AND METHOD OF OPERATION

TECHNICAL FIELD

The present invention relates to a high efficiency thermoelectric cooling system incorporating one or more thermoelectric modules and its method of operation.

BACKGROUND ART

It is known in the prior art to refrigerate small enclosures by the use of thermoelectric modules. Typically, a thermoelectric module comprises a plurality of semi-conductors of the N-P type which are connected in series by a conductive material and thermally conductive plates. The semi-conductors are sandwiched between the plates and the current flow therein transfers heat from one plate to the other and this is well known as the Peltier effect. Accordingly, when current flows in the circuit, one of the plates is cold and the other is hot, thus the thermoelectric effect. A cold plate is actually another name for a cold side heat sink. Thermoelectric modules (TM) have a cold side and a hot side. The heat sink (or hot side heat sink) is mounted on the hot side of the TM, while the cold plate is mounted on the cold side of the TM.

One problem with the use of these thermoelectric modules is that as the temperature differential across the module becomes greater, its efficiency decreases. As efficiency is driven lower the cost of powering these devices increases and therefore these device have not been found applicable for use with large refrigeration units. The thermal stress, caused by large temperature differentials ΔT, across the module also damages the module. Further, because these thermoelectric modules are often connected in series with one another to provide ample heat transfer, thermal stress across these modules becomes very problematic if one of these modules or many become defective rendering the assembly inefficient and costly. Heretofore, inadequate solutions have been proposed to evacuate heat from the hot plate of the module at a rate sufficient to control temperature differential between the cold and hot plates of the module and these modules continue to be stressed by expansion and contraction which often cause excessive power consumption and cracking of the module.

Heretofore, in order to evacuate heat from the hot plate, heat sinks are secured to the hot plate and fans are used to circulate air through the heat sink. However, because ambient air outside a refrigeration unit using the thermoelectric module is often warm air it is not possible to significantly reduce the temperature differential across the thermoelectric module whereby to enhance the efficiency thereof. U.S. Patent Application 2006/0117761 A1, published on Jun. 8, 2006 and entitled "Thermoelectric Refrigeration System", proposes an apparatus for thermoelectric cooling of an insulated enclosure using these modules and wherein heat pipes are used in conjunction with stacks of heat transfer fins whereby to more effectively transfer heat from the interior of the insulated enclosure and to also dissipate heat from the hot plate at the exterior of the enclosure. By the application of this heat pipe technology, the solution proposed in that publication is said to minimize thermoresistance across the thermoelectric modules. At both the hot and cold sides, the thermoelectric modules are joined to one face of a conductive copper plate and the heat pipes are joined to the opposite face thereof. The connecting copper plate is said to tend to balance loading of the module and of the heat pipes. The opposite ends of the heat pipes are joined into a stack of fins so as to provide adequate heat transfer area. This Publication also suggests ramping up and down the power supply to the thermoelectric modules whereby to reduce stress which is caused by pulse width modulated (PWM) current supplies where the supply is either ON or OFF inducing thermal shock in the module. The above-referenced Publication suggests the use of a variable power drive wherein the power supplied from 120 VAC source is connected to a power rectifier and a low voltage rectifier. The output from the low voltage rectifier supplies 12 VDC to a set point controller and a temperature sensor which responds to the temperature within the insulated enclosure. The set point and temperature DC signals are compared in a logic circuit and if the sensed temperature is more than 5 to 8° F. higher than the set point, a signal is sent to the power control device which ramps up the supply to full power over a period of 20 to 30 seconds from its initial level to maximum and this drive voltage is regulated by the logic circuit by decreasing the dry voltage proportionally to the decrease in temperature sensed by the sensor until a steady state condition is reached. Therefore, the power supply controller provides full power to the thermoelectric module for maximum cooling and down to some fraction of this as the temperature of the enclosure drops and only enough to counter thermal leakage once set point temperature is achieved. However, this variable power drive still results in excess power consumption and does not effectively control the temperature differential (ΔT) across the hot and cold plates of the thermoelectric module when exterior temperature at the fin stade are high.

Prior art devices have addressed the problem of heat transfer to and from thermoelectric modules by respective heat pipes by using common working fluid evaporator or condenser volumes to interface with a grouping of modules. The inherently unequal distribution and inefficient fluid flow characteristics cause unequal module load distribution as a basic problem in such a configuration. In addition, since heat pipes commercially available only as closed end tubes, manufacturing costs of such a configuration are excessive for commercial applications. This is especially true if the heat pipes are of the wicked and cored type, as are desirable for this application. Osmotic or mechanically pumped heat pipes introduce added complexity and expense to a device. Loop configuration heat pipes will have thermal gradients from top to bottom, inasmuch as this is the mechanism used to cause the fluid to rise in one arm of the loop and fall in the other. In this application, thermal gradients may cause thermal stress and unequal sharing of heat pumping loads in the modules. Basic open thermo-syphon configuration, without core or wicking, are low efficiency devices because of liquid pooling and thermal resistance effects in the fluid itself. Another problem is that as the fluid evaporates, it forms bubbles on the walls of the evaporator section that insulate the wall from the fluid. At the condensing end of a thermo-syphon, as the fluid becomes a liquid, the droplets interfere with contact of the vapor to the wall, again reducing efficiency. Any increase of the amount of heat energy to be transferred increases the magnitude of the problems in a thermo-syphon.

It is well known that as heat is displaced across the thermoelectric module this will cause a rise in temperature across the cold and hot plates of the module and this degrades the ability of the module to pump heat. The heat sinks connected to the cold and hot plates also build a thermal resistance and results in a significant temperature differential between the cold and hot plate. There is therefore a need to effectively manage the temperature differential across the thermoelectric module to increase the efficiency and life thereof as well as its power consumption.

The use of thermoelectric cooling modules in the construction of refrigerated enclosures has advantages and inconveniences. One advantage of these thermoelectric modules is that they do not use compressors and refrigerant conduits and associated devices which occupy a large space and which are noisy and often require maintenance. However, thermoelectric cooling modules have various inconveniences in that they are less efficient than conventional refrigeration systems using compressors and they are more expensive. Thermoelectric modules are also difficult to modulate by using a pulse width modulated (PWM) supply. It is also difficult to transfer heat quickly from an enclosure intended to be refrigerated.

SUMMARY OF INVENTION

It is a feature of the present invention to provide a high efficiency thermoelectric cooling system which uses one or more thermoelectric modules and wherein the modules are powered by a smooth continuous variable direct current supply whereby to attenuate thermal stress in the conductive plates and increase the life expectancy thereof.

Another feature of the present invention is to provide a high efficiency thermoelectric cooling system having a hot plate heat transfer device with improved efficiency.

Another feature of the present invention is to provide a high efficiency thermoelectric cooling system and wherein the hot plate and the hot plate heat transfer device are separated by a thermally insulated separation gap and wherein the separation gap provides for the encapsulating of the hot side of the thermoelectric system in a wall of an insulated enclosure by means of an injected thermally insulating foam material.

Another feature of the present invention is to provide a high efficiency thermoelectric cooling system to which is adapted an air convection housing having automatically operated hinge gates to communicate a desired air flow across the heat sink of the hot plate of the thermoelectric module.

Another feature of the present invention is to provide a high efficiency thermoelectric cooling system and wherein the air convection housing is provided with compartments adapted to direct ambient air or cooler air outside a building in which the insulated housing is secured to extract heat from the heat sink connected to the hot plate of the thermoelectric module and to redirect said air flow to either the ambient air or to outside air.

Another feature of the present invention is to provide a high efficiency thermoelectric cooling system which incorporates a programmable computer controller to automatically control the system to maintain a set temperature value in the insulated enclosure containing one or more thermoelectric modules.

It is also a feature of the present invention to provide a high efficiency thermoelectric cooling system which generates very little noise and which consumes very little energy once a refrigerated enclosure has reached its set point temperature, and wherein the set point is precise.

According to another feature of the present invention there is provided a method for increasing the efficiency and life span of a thermoelectric module.

According to the above features, from a broad aspect, the present invention provides a high efficiency thermoelectric cooling system which is adapted for refrigerating an insulated enclosure. The cooling system comprises a thermoelectric module having a semi-conductor body sandwiched in contact between a pair of thermally conductive plates. A power supply having converter circuit means provides a smooth continuous variable output direct current supply to the semi-conductor body to attenuate thermal stress in the conductive plates due to temperature differential fluctuation across the plates. One of the plates is a cold plate and the other a hot plate caused by current flow in the semi-conductor body transferring heat from the cold plate to the hot plate. Heat transfer means is associated with the cold plate to absorb heat from the insulted enclosure to cool the enclosure. Heat convection means evacuates heat from the hot plate to effectively manage the temperature differential across the plates. Mounting means is adapted to secure the thermoelectric cooling device to a wall of the insulated enclosure with the heat convection means disposed exteriorly of the insulated enclosure.

According to a further broad aspect of the present invention there is provided a method of increasing the efficiency and life span of a thermoelectric module formed of a semi-conductor body sandwiched in contact between a pair of thermally conductive plates. The method comprises converting a pulse width modulated direct current supply to a smooth continuous variable output direct current supply, and feeding the smooth continuous variable output direct current supply across the semi-conductor body to obtain a continuous current flow in the semi-conductor body to continuously transfer heat from one of the pair of thermally conductive plates to the other in an uninterrupted manner.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
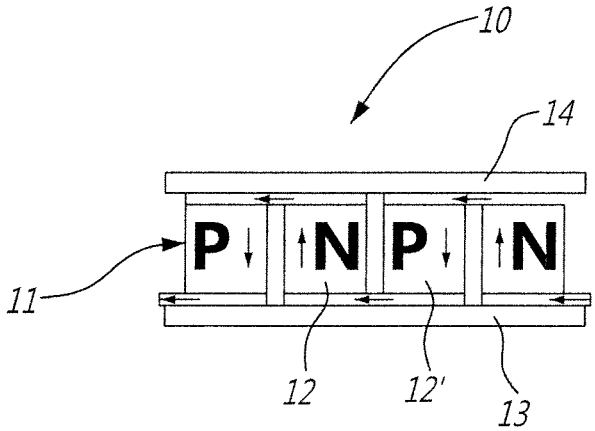
FIG. 1 (PRIOR ART)
FIG. 1 is a simplified view of a thermoelectric module constructed in accordance with the prior art.

Referring now to the drawings and more particularly to FIG. 1, there is shown generally at 10 a typical thermoelectric module of the prior art. It comprises a semi-conductor body 11 formed of N and P type semi-conductors 12 and 12', respectively, which are sandwiched in contact between a pair of thermally conductive plates, herein a hot plate 13 and a cold plate 14. Due to current flow in the semi-conductor body 11, one of the plates, namely plate 13 becomes hot and the other plate 14 becomes cold due to the well known Peltier effect.

Figure 2:
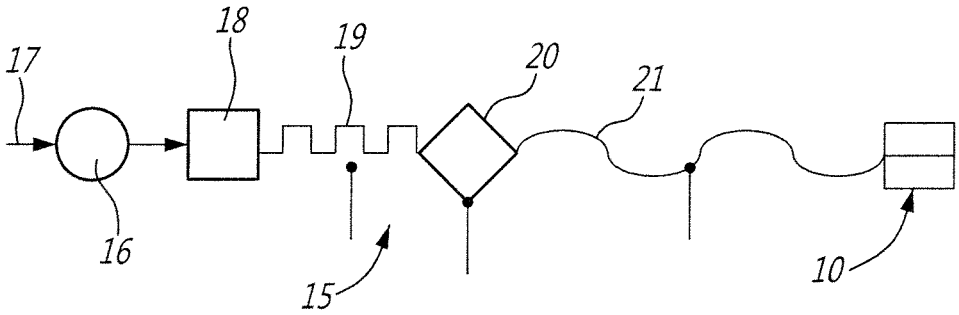
FIG. 2 is a simplified schematic diagram illustrating the power supply for the thermoelectric module using a converter circuit to transform a pulse width modulated current into a smooth continuous variable output direct current supply to feed the thermoelectric module.

Referring now to FIG. 2, there is shown a block diagram of the supply circuit of the present invention. It is customary to drive the thermoelectric modules by the use of a pulse width modulated (PWM) current which is a square wave current supply 19. This current supply 19 is an interrupted ON and OFF supply thus causing current in the semi-conductor body 11 to operate in an ON and OFF manner and which, as discussed previously, would stress the thermoelectric module and thereby reduces its life span. As shown in FIG. 2, the power supply circuit 15 of the present invention consists of a DC transformer 16 which receives an AC current 17 at an input thereof. The output of the transformer 16 is connected to a circuit arrangement of power transistors 18 which produce the pulse with modulated current 19. Thus far, this circuit is well known in the art. However, in order to increase the life expectancy of the thermoelectric module 10, the present invention converts this pulse width modulated current 19 with a converter circuit 20, the details of which will be described later, to produce a smooth continuous variable output direct current supply 21 which is applied to the semi-conductor body 11 of the thermoelectric module 10 as herein illustrated. Such a supply attenuates thermal stress in the conductive plates which is due to temperature differential fluctuations across the plates. Details of the construction and operation of the power supply circuit 15 will be described later with reference to FIGS. 7A and 7B.

Figure 3:
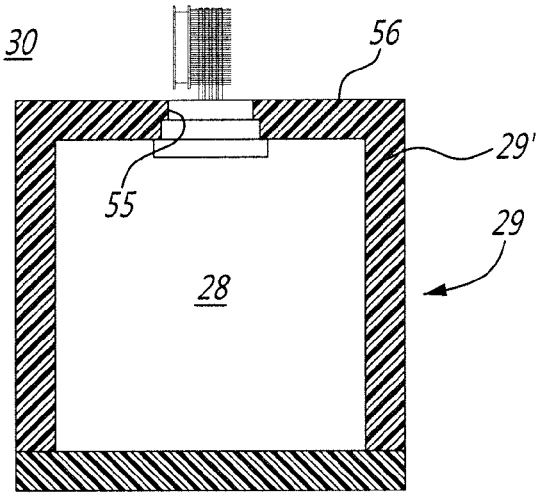
FIG. 3 is a simplified transverse cross-section view showing an insulated enclosure equipped with the high efficiency thermoelectric cooling system of the present invention.
Figure 4A:
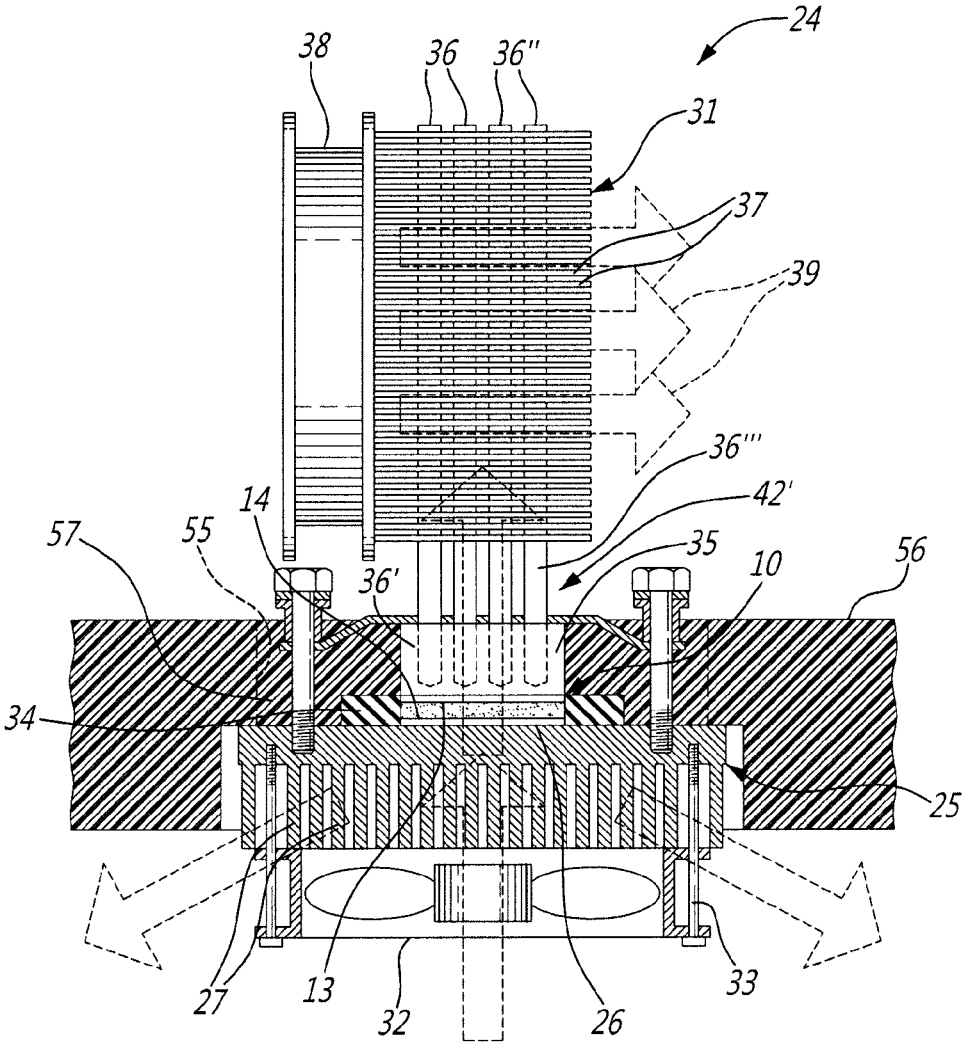
FIG. 4A is a simplified view illustrating the construction of the high efficiency thermoelectric cooling system of the present invention.
Figure 4B:
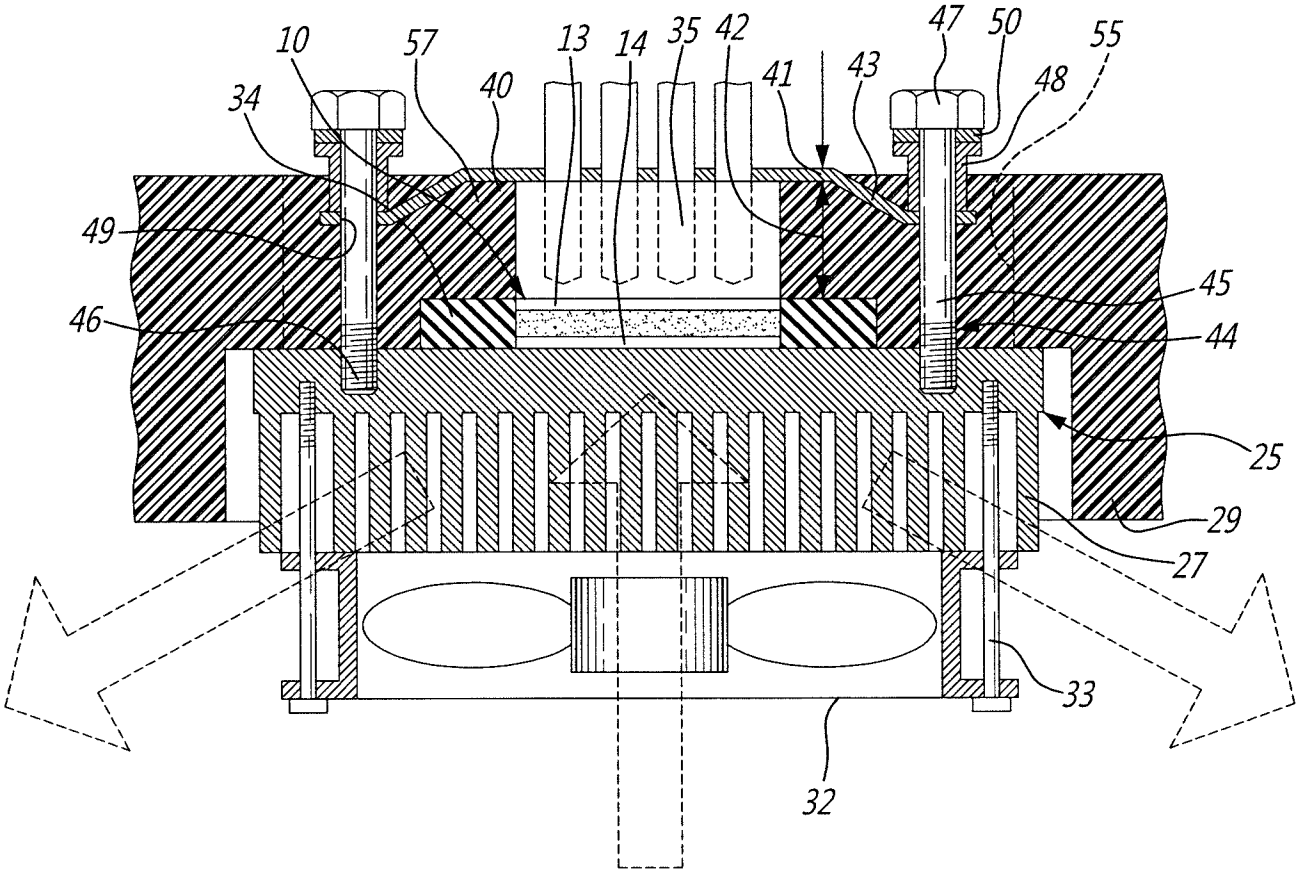
FIG. 4B is an enlarged view of a portion of FIG. 4A.

With reference now to FIGS. 4A and 4B, there is shown the construction of the high efficiency thermoelectric cooling system of the present invention. As hereinshown, the thermoelectric module 10 has a heat sink 25 provided with a planar surface 26 secured in flush contact with the cold plate 14 of the thermoelectric module 10. The heat sink 25 has a plurality of spaced-apart fins 27 to absorb heat from the interior space 28 of an insulated enclosure 29 and to transfer this heat through the thermoelectric module to the exterior ambient area 30 of the refrigerated enclosure 29, as shown in FIG. 3. This heat transfer is effected through a hot heat sink assembly 31 which is connected to the hot plate 13 of the thermoelectric module. A fan 32 is connected to the heat sink 25 of the cold plate, hereinshown against the fins 27, to draw the warm air from the area 28 to be refrigerated, of the enclosure 29, into the fins of the heat sink 25 to transfer this warm air onto the cold plate 14 for transfer. Bolts 33 secure the fan 25 against the heat sink 25.

As shown in FIGS. 4A and 4B, a neoprene seal 34 is secured in peripheral contact about the thermoelectric module 10 to insulate the cold plate 14 from the hot plate 13. Also in flush contact with the hot plate 13 there is provided a thermally conductive metal block 35 through which is secured one or more heat pipes 36. The heat pipes 36 have a connection portion 36' secured in the thermally conductive block 35, and a straight naked portion 36''' to form a space gap 42' as illustrated in FIG. 4B, to provide a space between the heat sink 31 and the bracket 41 to permit the injection of insulating foam material for securing the module in an enclosure wall and a heat dissipation portion 36'' secured to the heat sink 31. The space gap 42' can be thinner or thicker than the enclosure wall. The heat sink 31 is formed as a large stack of a plurality of closely spaced parallel thin heat conductive plates or fins 37. The fins 37 are oriented transversely to the heat dissipating portion 36'' of the heat pipes 36. The heat dissipation portion of these pipes is a straight portion and these pipes are separated from one another in the stack of heat conductive fins to distribute heat throughout quickly. A fan 38 convects the ambient air through the heat sink 31 in the direction of arrows 39 through the gaps between the fins. The heat pipes are configured to separate the heat sink 31 as far as possible from the cold plate heat sink 25.

A spacer 40 constructed of PVC material, or other suitable material, is retained about the thermally conductive block 35 by a compression bracket 41 to form a large separation gap 42 between the bracket 41 and the cold heat sink 25. The naked portion 36''' of the heat pipes 36 which extracts heat from the hot plate 14 through the conductive block 35 simply moves heat for dissipation further away by the fins 37 of the hot heat sink 31. Heat pipes are known in the art and they contain a heat transfer fluid which is retained captive in the pipes and adapted to cycle within the pipes to transfer heat from the hot plate 13 to the heat sink 31. The heat pipes 36 are shaped to accommodate the separation gap 42 and space gap 42' and as hereinshown they are bent at a lower end to form a U-shaped portion 36' which is retained captive in the conductive block 35. The spacer 40 is a mineral fiber and particulate matter board or other suitable filler material.

As better shown in FIG. 4B, the compression bracket 41 is provided with securement flanges 43 adapted to receive thermally insulating fasteners, herein nylon bolt fasteners 44, to secure the thermally conductive block 35 and spacer 40 captive over the hot plate 13. These nylon bolt fasteners 44 have a shaft portion 45 provided with a threaded end 46 and an engageable head portion 47. A spacer cylinder 48 is disposed about the shaft portion 45 and positioned about a fastener receiving bore in the flanges 43 of the compression bracket 41 and sits outwardly of the compression brackets whereby to space the head portion 47 of the bolt fasteners 44 outwardly of the separation gap 42. A spring washer 50, herein a Belleville washer, is retained between the spacer cylinder 48 and the bolt head portion to compensate for minor displacement of the secured parts due to thermal expansion and contraction. As hereinshown the threaded ends 46 of the bolts are secured in the planar surface 26 of the heat sink 25 secured to the cold plate 14. The nylon fasteners avoid thermal bridge. Using multiple fasteners 44 removes mechanical stress on each one, and are easier to torque with precision.

In order to secure the thermoelectric cooling assembly shown in FIG. 4 to the thermally insulated wall 29' of the insulted enclosure 29 of FIG. 3, a securement cavity 55 is formed in the wall 29' of the enclosure at the location where the cooling unit is to be located. As shown in FIG. 3, it is located in the rear wall but it could also be conveniently located in the top or side walls of the insulated enclosure 29. To secure the thermoelectric cooling unit, shown in the embodiment of FIG. 4, it is necessary to position the assembly with the heat sink 31 positioned outwardly of the enclosure and the space gap 42' disposed such as to position the compression bracket 41 substantially in line with the outer surface 56 of the wall 29'. A quick-set thermal insulating foam 57 is then injected in the securement cavity 55 to fill the space gap 42' or part thereof and when solidified about the bolts and the other elements, as shown in FIG. 4, solidly retains the thermoelectric cooling assembly 24 in position.

Figure 5:
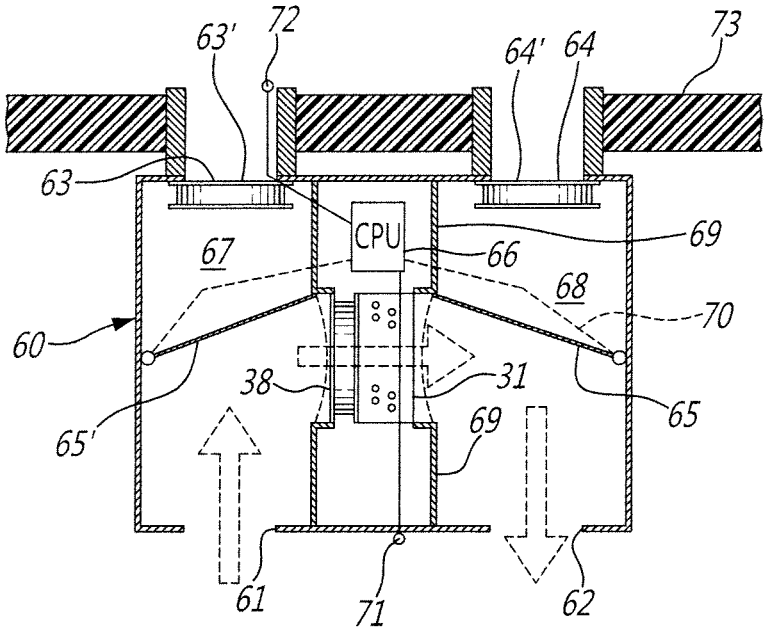
FIG. 5 is a simplified section view showing the construction of the air convection housing with the hinge gates in a first position to provide for ambient air flow across the hot plate heat sink.
Figure 6:
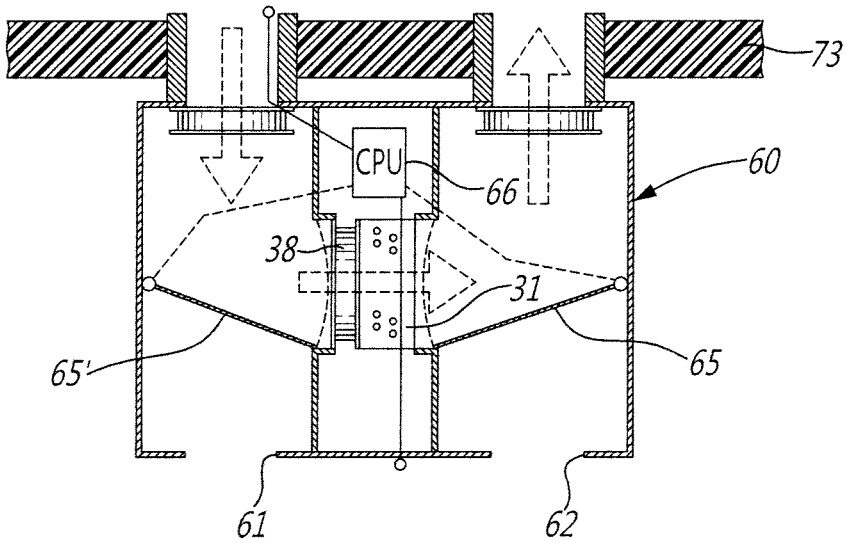
FIG. 6 is a view similar to FIG. 5 but showing the hinge gate in a second position allowing for exterior air convection flow across the heat sink of the hot plate.

Referring now to FIGS. 5 and 6, there is shown a heat channeling means in the form of an air convection housing 60 adapted to be secured about the heat sink 31 and fan 38 assembly which is spaced from the outer surface 56 of the insulated enclosure 29. This air convection housing 60 is secured to the wall 29' of the enclosure 29 by suitable connection means, not shown but obvious to a person skilled in the art. The housing 60 has an interior/ambient air intake port 61 and interior/ambient air exhaust port 62. It also has an exterior air intake port 63 and an exterior air exhaust port 64. A pair of hinge gates 65 and 65' communicate the heat sink element 31 between a selected one of the interior and exterior air intake ports to a selected one of the interior and exterior air exhaust ports as determined by a program CPU controller 66 or manually set by a user person. The hinge gates 65 and 65' are motor-controlled gates but could also be manually controlled.

As hereinshown the exterior air intake and exhaust ports 63 and 64 are equipped with fans 63' and 64' for drawing exterior air from outside a building containing the cooling device and into the air convection housing 60 and exhausting heating air passing through the heat sink 31 to the exterior of the building wall 73 via the exhaust port 64. The fans 63', 38 and 64' are placed in operation by the CPU controller 66 and the fan speeds can be modulated thereby. Air filters may also be secured against the fans 63' and 64'. By using cooler outside air the $\Delta T$ across the thermoelectric module is reduced and less energy is consumed.

As shown in FIGS. 5 and 6, the air convection housing 60 is also divided into two compartments, namely compartments 67 and 68 and which compartments are separated by a division wall structure 69. The compartments 67 and 68 communicate with one another through the fan 38 positioned adjacent the heat sink 31 and mounted in the division wall structure 69. The interior and exterior air intake ports 61 and 63 communicate with compartment 67 and the interior and exterior air exhaust ports 62 and 64 communicate with compartment 68. As previously mentioned, the hinge gates 65 and 65' are motorized gates, the motors of which, not shown, are controlled by a connection 70, hereinshown in phantom lines, with the CPU controller 66. Flexible insulated conduits, not shown, may be used between the air intake port 63 and the hole in the building wall and also between the port 64 and the wall 73 if the refrigerated housing is located spaced therefrom.

The CPU controller 66 is a programmable computer controller which has a memory for storing statements and instructions for use in the execution of program functions by the CPU. Temperature sensors such as sensor 71 and 72 monitor the temperature inside the building structure 73 and outside the building structure, respectively, and feeds temperature signals to the CPU as herein illustrated whereby the CPU will control the gate positions depending on the value of these signals and a desired set temperature value of the refrigerated unit stored in its memory. A further sensor (not shown) senses the temperature of the heat sink 31. As hereinshown, the CPU is also mounted in the divisional wall structure 69 but it could be placed anywhere in the enclosure, or even remotely, and control multiple enclosures and their motorized hinge gates, as further described with reference to FIGS. 5 and 6.

As shown in FIG. 5, the hinge gates 65 and 65' are in a first position whereby the interior air intake port 61 and the interior air exhaust port 62 are in communication with one another through the fan 38 and the heat sink 31 whereby to extract heat from the heat sink 31 by convecting ambient air in the vicinity of the insulated enclosure 29. As shown in FIG. 6, the gates 65 and 65' are in a second position whereby to communicate the outside air intake port 63 with the outside air exhaust port 64 and again through the fan 38 and heat sink 31. Although not shown, the gates 65' and 65 could be positioned such as to communicate the exterior air intake port 63 with the interior air exhaust port 62 to cool the heat sink 31 and provide fresh heated outside air inside the building structure 73. Alternatively, the gates may be positioned whereby interior ambient air is fed through the air intake port 61 and exhausted to the outside air of the building wall 75 through the exhaust port 64 and this depending on the ambient air surrounding the insulated enclosure 29 and outside air temperature. Various temperature sensors are provided whereby the CPU controller can operate the gates in a manner to render the thermoelectric assembly 24 more efficient. For example, the heat generated by the heat sink 31 may be circulated to the ambient air surrounding the insulted enclosure to be used for heating the ambient air during winter months or to expel the heated air to the outside if the ambient air is conditioned in summer months.

Figure 8:
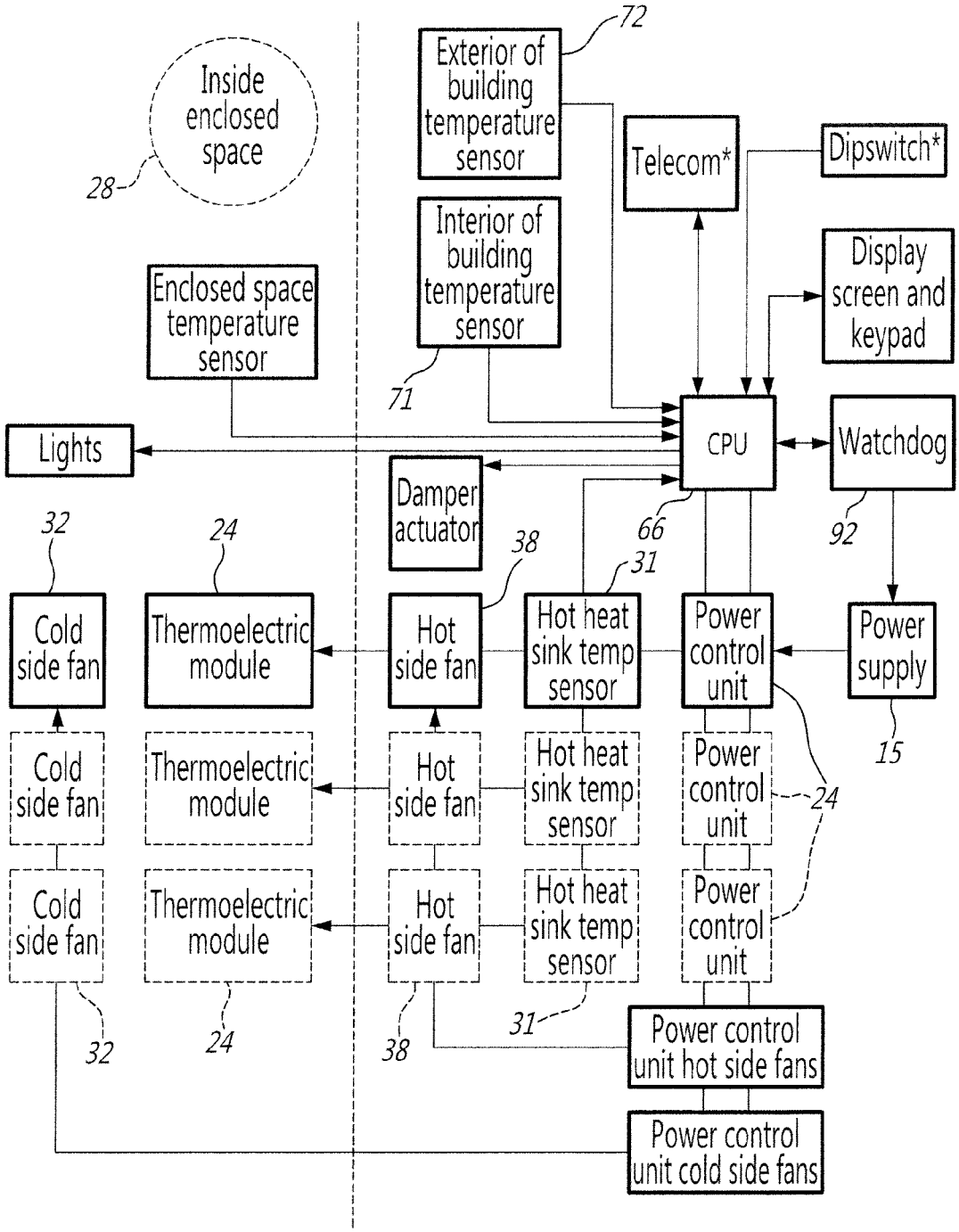
FIG. 8 is a block diagram illustrating the system and its controls and the location of elements disposed inside and outside the insulated refrigerating enclosure.

FIG. 8 is a block diagram showing the CPU controller 66 and associated devices and circuits. As hereinshown there may be three thermoelectric cooling assemblies 24 connected in series with one another in a large refrigeration insulated enclosure which may be a large refrigerator or large wine cooler or a large computer enclosure or telecommunication equipment enclosure which requires heat extraction therefrom by the use of a unit which is compact, quiet and efficient.

Figure 7A:
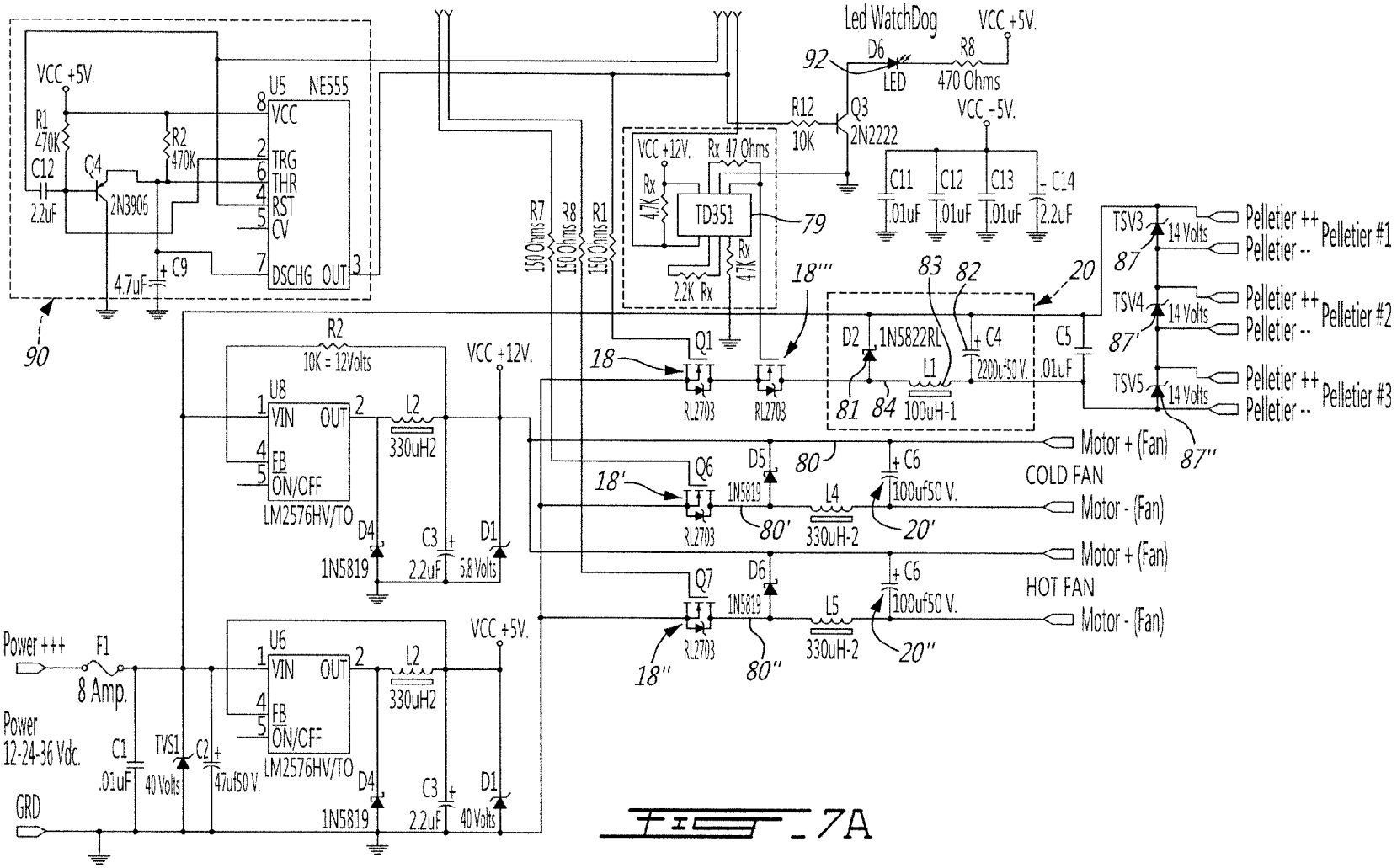
FIG. 7A is a detailed circuit diagram of a first portion of the system showing the construction of the supply circuit, the watch dog circuitry as well as sensors and other circuits associated with the CPU.
Figure 7B:
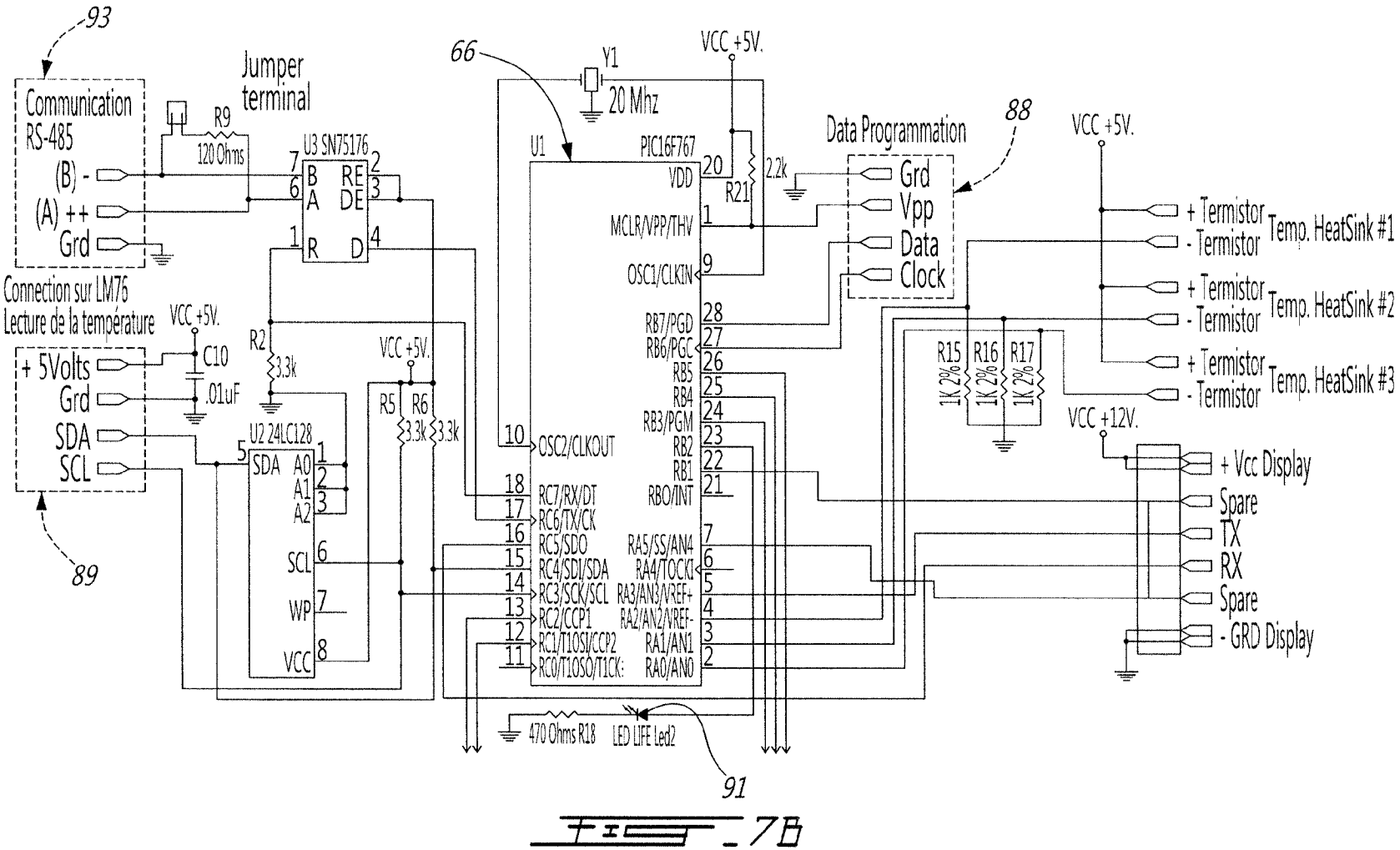
FIG. 7B is a further portion of the circuit diagram.

Referring now to FIGS. 7A and 7B, there is shown the circuitry associated with the thermoelectric modules 10 and the CPU 66 of the high efficiency thermoelectric cooling system of the present invention. As shown in FIG. 7A, the power transistor circuits, three of which are shown, are comprised of power mosfets 18, 18' and 18" and they supply a pulse width modulated supply current on their outputs 80, 80' and 80", respectively, to a respective converter circuit 20, 20' and 20". The converter circuits 20 are bridge circuits each comprising a schottki diode 81 connected to the output 80 and an electrolytic capacitor 82 connected in parallel therewith. A discharge coil 83 is connected between the leg connections 84 and 85 of the schottki diode 81 and capacitor 82, respectively. This bridge circuit converts the pulse width modulated current into a ramp up and ramp down supply 21, as shown in FIG. 2, which provides the continuous smooth variable output direct current supply 21 to maintain uninterrupted current flow in the semi-conductor body of the thermoelectric modules, as previously described. As hereinshown, the first supply 18 feeds the thermoelectric modules, each connected in series and across transiac diodes 87, 87' and 87", respectively. These transiac diodes are provided to equalize the supply current to the three modules connected in series and this prevents an unbalance of the current supply which would cause one of the modules to produce more heat than the others. These diodes prevent this malfunction to occur. The other two supplies 18 and 18' drive the cold fan 32 and hot fan 38. A fourth power mosfet 18'" acts as a gate actuated by a watch dog circuit 79 to cut the supply from power mosfet 80 in the event of CPU 66 malfunction.

The operation of the circuit is as follows. Depending on the desired set point temperature stored in the memory of the CPU 66, which is programmed by a user person, and the interior temperature of the enclosure which is present at the port 89, the CPU 66 will send signals of the required supply to the mosfet driver circuit 18 whereby to control these power transistors. As previously described, the CPU controls the speed of the fans associated with the hot heat sink 31 and the fans 63' and 64' associated with the exterior air intake and air exhaust ports, when provided. A watch dog circuit 79 is provided to monitor the operation of the CPU 66. If the CPU does not send any signals for a time delay of about 1 second, the watch dog circuit will cut the power supply to the thermoelectric modules and will also extinguish the "life" LED light 91 and cause a watch dog LED light 92 to light up as well as sending an error signal to the CPU. A port 93 also permits the control of many insulated enclosures in a network by the use of a single CPU 66 program to do so. Connection port 88 is provided to load or update the firmware of the CPU 66.

It is also pointed out that by modulating the current supply to the thermoelectric modules as well as modulating the fans results in less consumption of energy and a more precise control of the set desired temperature inside the refrigerated insulated enclosure.

The method of operation as herein-described can be summarized as one which increases the efficiency and life span of a thermoelectric module which is used for refrigerating an insulated enclosure. The method comprises converting a pulse width modulated direct current supply to a smooth continuous variable output direct current supply, and feeding this continuous variable output direct current supply across the semi-conductor body of the thermoelectric module to obtain a continuous current flow in the semi-conductor body to continuously transfer heat from one of the pair of thermally conductive plates to the other in an uninterrupted manner. The method further provides for the provision of heat channeling means to direct a cool exterior air flow across the hot heat sink device and this is achieved by isolating the heat sink device in an air convection chamber and operating hinge gates to establish a cooling air convection path across the heat sink device. The CPU is also programmed to automatically select a desired cooling air convection path by using outside air of a building containing the insulated enclosure or ambient air about the enclosure and exhausting the cooling air fed through the hot heat sink which has now been heated to either the ambient air or to the outside air depending on climatic conditions or other program factors.

It is within the ambit of the present invention to cover any obvious modifications of the preferred embodiment described herein provided such modifications fall within the scope of the appended claims.

I claim:

1. A high efficiency thermoelectric cooling system adapted for refrigerating an insulated enclosure, said cooling system comprising a thermoelectric module having a semi-conductor body sandwiched in contact between a pair of thermally conductive plates, a power supply having converter circuit provides a smooth continuous variable output direct current supply to said semi-conductor body to attenuate thermal stress in said conductive plates due to temperature differential fluctuation across said plates, one of said plates being a cold plate and the other a hot plate caused by current flow in said semi-conductor body transferring heat from said cold plate to said hot plate, a cold heat sink element secured to said cold plate to absorb heat from the insulted enclosure to cool the enclosure, a heat convection assembly to evacuate heat from said hot plate to effectively manage the temperature differential across said plates, said heat convection assembly having two or more heat pipes having a connection portion for absorbing heat from said hot plate and a heat dissipating portion secured to a hot heat sink element spaced from said thermally conductive block to define a space gap between said hot plate and said heat sink element, a fan secured directly to said hot heat sink element which is secured to said heat dissipating portions to evacuate heat outside said insulated enclosure, said fan producing a heat dissipating force convection flow parallel to a stack of a plurality of heat conductive fins of said hot heat sink element, said thermoelectric cooling device being mounted in a securement cavity formed in a wall of the insulated enclosure with said heat convection means disposed exteriorly of said insulated enclosure, a heat channeling air convection housing secured to said wall of the insulted enclosure and about said hot heat sink element and said fan, said air convection housing having an interior air intake and exhaust port and an exterior intake and exhaust port, hinge gates communicating said hot heat sink element between a selected one of said interior and exterior air intake ports to a selected one of said interior and exterior air exhaust ports.

2. A high efficiency thermoelectric cooling system as claimed in claim 1 wherein said cold heat sink element has a planar surface secured in flush contact with said cold plate, said cold heat sink element having a plurality of spaced-apart fins, and a fan secured to said cold heat sink element to direct air from said insulated enclosure against said fins.

3. A high efficiency thermoelectric cooling system as claimed in claim 2 wherein there is further provided a peripheral seal in peripheral contact and about said thermoelectric module to insulate said cold plate from said hot plate.

4. A high efficiency thermoelectric cooling system as claimed in claim 3 were said peripheral seal is a neoprene seal.

5. A high efficiency thermoelectric cooling system as claimed in claim 1 wherein a spacer member is retained adjacent and about said thermally conductive block by a compression bracket to form a space gap extending between said cold heat sink element secured to said cold plate and said hot heat sink element which is secured to said heat dissipating portion of said one or more heat pipes.

6. A high efficiency thermoelectric cooling system as claimed in claim 1 wherein said heat pipes contain a heat transfer fluid retained captive therein and adapted to cycle within said pipes to transfer heat from said hot plate to said heat sink.

7. A high efficiency thermoelectric cooling system as claimed in claim 5 wherein said heat pipes are shaped to accommodate said space gap, said heat dissipation portion extending transversely of said thermally conductive block from opposed sides thereof and transversely to a stack of a plurality of parallel closely spaced thin heat conductive fins of said hot heat sink, said fan being oriented to direct an air flow between said fins of said stack of fins.

8. A high efficiency thermoelectric cooling system as claimed in claim 5 wherein said compression bracket is provided with thermally insulating fasteners to secure said thermally conductive block captive over said hot plate.

9. A high efficiency thermoelectric cooling system as claimed in claim 8 wherein said thermally insulating fasteners are nylon bolt fasteners.

10. A high efficiency thermoelectric cooling system as claimed in claim 8 wherein said fasteners are bolt fasteners having a shaft portion provided with a threaded free end and an engageable head portion, a spacer about said shaft portion and positioned about a fastener receiving bore outwardly of said compression bracket to space said head portion outwardly of said separation gap, and a spring washer between said spacer and said bolt head portion.

11. A high efficiency thermoelectric cooling system as claimed in claim 10 wherein said threaded free end of said bolt fasteners is secured to said planar surface of said heat sink element secured to said cold plate.

12. A high efficiency thermoelectric cooling system as claimed in claim 7 wherein said space gap is disposed in said securement cavity, and an insulating foam injected into said securement cavity, or part thereof, to seal said space gap, or part thereof, and form a connection with said wall of said insulated enclosure with said heat sink element secured to said heat dissipation portion of said two or more heat pipes spaced outwardly of said wall of said insulated enclosure.

13. A high efficiency thermoelectric cooling system as claimed in claim 1 wherein said exterior air intake and exhaust ports are provided with fans for drawing exterior air from outside a building containing said cooling device and into said air convection housing and exhausting heated air passing through said hot heat sink to the exterior of the building.

14. A high efficiency thermoelectric cooling system as claimed in claim 1 wherein said air convection housing is divided into two compartments separated by a division wall structure, said compartments communicating with one another through said fan positioned adjacent said hot heat sink and mounted in said division wall structure of said convection housing, said interior and exterior air intake ports communicating with one of said compartments and said interior and exterior exhaust ports communicating with the other of said two compartments, and control means to control the position of said hinge gates.

15. A high efficiency thermoelectric cooling system as claimed in claim 14 wherein said control means is a programmable computer controller having a memory for storing statements and instructions for use in the execution of programmed functions by a CPU, and temperature sensors for monitoring interior temperatures of said insulated housing and exterior temperatures thereof for feeding temperature signals to said CPU for the positioning of said hinge gates.

16. A high efficiency thermoelectric cooling system as claimed in claim 15 wherein said CPU may be incorporated in said division wall structure or remotely thereof, said CPU having a connecting port positioned exteriorly of said convection housing for connection to a computer for programming said CPU.

17. A high efficiency thermoelectric cooling system as claimed in claim 15 wherein said hinge gates are motor-operated hinge gates controlled by said CPU, said hinge gates each being displaceable from a first to a second position depending on said temperature signals to communicate said exterior intake port to said exterior exhaust port through said fan and hot heat sink in said division wall structure or to communicate said interior intake port to said interior exhaust port through said fan and heat sink in said division wall structure.

18. A high efficiency thermoelectric cooling system as claimed in claim 17 wherein said hinge gates are also displaceable by said CPU to communicate said interior intake port with said exterior exhaust port through said fan and hot heat sink in said division wall structure.

19. A high efficiency thermoelectric cooling system as claimed in claim 17 wherein said CPU modulates said fans of said exterior intake and exhaust ports according to cold air requirements as determined by desired temperature parameters stored in said memory of said CPU.

20. A high efficiency thermoelectric cooling system as claimed in claim 15 wherein there is further provided a temperature sensor associated with said hot heat sink for generating temperature signals to said CPU for the control of the speed of operation of said fans of said exterior air intake and exhaust ports.

21. A high efficiency thermoelectric cooling system as claimed in claim 1 wherein said converter circuit is connected at an output of a pulse width modulated direct current of a supply circuit and comprises a bridge circuit including a schottki diode connected across said supply circuit, an electrolytic capacitor connected in parallel with said diode and a discharge coil connected intermediate a leg connection of said diode and said capacitor, said bridge circuit converting said pulse width modulated current into a ramp-up/ramp-down current supply constituting said smooth continuous variable output direct current supply to maintain uninterrupted current flow in said semi-conductor body and heat transfer between said cold plate and hot plate during operation of said thermoelectric module.

22. A high efficiency thermoelectric cooling system as claimed in claim 21 wherein a CPU controls a power transistor circuit feeding said pulse width modulate direct current supply to said converter circuit means depending on a set point temperature required for said insulated enclosure and stored in the memory of said CPU, and temperature sensing means in said insulated enclosure for feeding actual temperature signals to said CPU.

23. A method of increasing the efficiency and life span of a thermoelectric module formed of a semi-conductor body sandwiched in contact between a pair of thermally conductive plates, said method comprising the steps of:

i) converting a pulse width modulated direct current supply to a smooth continuous variable output direct current supply, ii) feeding said smooth continuous variable output direct current supply across said semi-conductor body to obtain a continuous current flow in said semi-conductor body to continuously transfer heat from one of said pair of thermally conductive plates to the other in an uninterrupted manner, iii) forming a space gap between a hot thermally conductive plate of said pair of thermally conductive plates and a hot heat sink element to permit the injection of insulating foam material therein to provide the securement of said thermoelectric module in a wall opening of an insulated enclosure to be refrigerated with a hot heat sink supported exteriorly of said enclosure, iv) isolating said hot heat sink element in an air convection housing;

v) operating hinge gates to establish a cooling air convection path across said hot heat sink element;

vi) monitoring temperatures in said insulated enclosure, outside said insulated enclosure and outside a building structure containing said insulated enclosure; and vii) automatically selecting a desired cooling air convection path to extract heat from said hot heat sink element.

24. A method as claimed in claim 23 wherein said step of converting comprises feeding said pulse width modulated direct current supply across a schottki diode connected in parallel with an electrolytic capacitor and a discharge coil connected in a leg connection of said schottki diode and said electrolytic capacitor.

25. A method as claimed in claim 23 wherein said step vii) is selected from one of: (1) an ambient air convection path outside said insulated enclosure, (2) an exterior air convection path using outside air from outside said building structure for an inlet of said convection path and an outlet thereof, and (3) an exterior air convection path using outside air for an inlet of said convection with an outlet thereof returning to ambient air outside said insulted enclosure, whereby to extract the maximum amount of heat from said hot heat sink element to thereby control the temperature differential across aid thermally conductive plates of said thermoelectric device and reducing power consumption.

26. A method as claimed in claim 25 wherein said hot heat sink element has a fan secured in relation therewith to create a forced airflow across said hot heat sink element, and further fans secured to said inlet and to said outlet of said exterior air convection path, said method further comprising the step of automatically controlling the operation of said fans based on temperature signals fed to a controller computer.

27. A high efficiency thermoelectric cooling system adapted for refrigerating an insulated enclosure, said cooling system comprising a thermoelectric module having a semi-conductor body sandwiched in contact between a pair of thermally conductive plates, a power supply having converter circuit provides a smooth continuous variable output direct current supply to said semi-conductor body to attenuate thermal stress in said conductive plates due to temperature differential fluctuation across said plates, one of said plates being a cold plate and the other a hot plate caused by current flow in said semi-conductor body transferring heat from said cold plate to said hot plate, a cold heat sink element secured directly to said cold plate to absorb heat from the insulted enclosure to cool the enclosure, a heat convection assembly to evacuate heat from said hot plate to effectively manage the temperature differential across said plates, said heat convection assembly having two or more heat pipes having a connection portion for absorbing heat from said hot plate and a heat dissipating portion secured to a hot heat sink element spaced from said thermally conductive block to define a space gap between said hot plate and said heat sink element, a fan secured directly to said hot heat sink element which is secured to said heat dissipating portions to evacuate heat outside said insulated enclosure, said fan producing a heat dissipating force convention flow parallel to a stack of a plurality of heat conductive fins of said hot heat sink element, said thermoelectric cooling device being mounted in a securement cavity formed in a wall of the insulated enclosure with said fan disposed exteriorly of said insulated enclosure, a peripheral neoprene seal secured in peripheral contact about said thermoelectric module to insulate said cold plate from said hot plate, said heat pipes extending transverse to a heat dissipating planar surface of said hot plate and through said space gap, said heat conductive fins extending parallel to said heat dissipating planar surface of said hot plate, said fan being oriented to direct an air flow between said fins of said stack of fins transversely of said heat dissipating planar surface of said hot plate, and a compression bracket having thermally insulating fasteners to secure said thermally conductive block captive over and about said hot plate.

28. A high efficiency thermoelectric cooling system as claimed in claim 27 wherein said cold heat sink element having a planar surface secured in flush contact with said cold plate, said cold heat sink element having a plurality of spaced-apart fins, and a fan secured to said cold heat sink element to direct air from said insulated enclosure against said fins.

29. A high efficiency thermoelectric cooling system as claimed in claim 27 wherein a spacer member is retained adjacent and about said thermally conductive block by a compression bracket to form a space gap extending between said cold heat sink element secured to said cold plate and said hot heat sink element which is secured to said heat dissipating portion of said one or more heat pipes.

30. A high efficiency thermoelectric cooling system as claimed in claim 27 wherein said heat pipes contain a heat transfer fluid retained captive therein and adapted to cycle within said pipes to transfer heat from said hot plate to said heat sink.

31. A high efficiency thermoelectric cooling system as claimed in claim 27 wherein said fasteners are thermally insulating bolt fasteners having a shaft portion provided with a threaded free end and an engageable head portion, a spacer about said shaft portion and positioned about a fastener receiving bore outwardly of said compression bracket to space said head portion outwardly of said separation gap, and a spring washer between said spacer and said bolt head portion.

32. A high efficiency thermoelectric cooling system as claimed in claim 27 wherein said space gap is disposed in said securement cavity, and an insulating foam injected into said securement cavity, or part thereof, to seal said space gap, or part thereof, and form a connection with said wall of said insulated enclosure with said heat sink element secured to said heat dissipation portion of said two or more heat pipes spaced outwardly of said wall of said insulated enclosure.

* * * * *